United States Patent [19]

Nagano et al.

[11] 4,211,556

[45] Jul. 8, 1980

[54] REVERBERATORY SMELTING OF NON-FERROUS METAL SULFIDE ORES

[75] Inventors: Takeshi Nagano, Tokyo; Motoo Goto, Kagawa; Yoshiyuki Tsuji, Iwaki, all of Japan

[73] Assignee: Mitsubishi Kinzoku Kabushiki Kaisha, Tokyo, Japan

[21] Appl. No.: 971,834

[22] Filed: Dec. 19, 1978

[30] Foreign Application Priority Data

Dec. 30, 1977 [JP] Japan ..... 52-160076

[51] Int. Cl.[2] ..... C22B 15/04

[52] U.S. Cl. ..... 75/74; 75/82

[58] Field of Search ..... 75/74, 72, 73, 75, 76, 75/82

[56] References Cited

U.S. PATENT DOCUMENTS

| | | | |
|---|---|---|---|
| 3,436,068 | 4/1969 | Beals et al. | 266/226 |
| 3,664,828 | 5/1972 | Worner | 75/73 |
| 3,890,139 | 6/1975 | Suzuki et al. | 75/74 |
| 3,901,489 | 8/1975 | Suzuki et al. | 266/171 |

*Primary Examiner*—R. Dean

*Attorney, Agent, or Firm*—Wenderoth, Lind & Ponack

[57] ABSTRACT

Banks of a green non-ferrous metal sulfide ore are formed along the inner surfaces of sidewalls of a reverberatory furnace of green-charge type and are melted thereby to form slag and matte, a major portion of the matte being tapped out of the furnace, while a mixture of the slag and the remainder of the matte is introduced into a separation furnace to be completely separated. During this process, an oxygen-containing gas is blown through lances, past the slag layer made thin by the tapping of the slag-matte mixture, and into the matte underlying the slag in the reverberatory furnace thereby to raise the copper metal content of the matte thus formed and, moreover, to increase the concentration of $SO_2$ in the resulting exhaust gas. By this method, the processing capacity of the reverberatory furnace is increased and, moreover, the load on a converter for further processing of the matte is reduced. At the same time, the exhaust gas can be used directly, as it is, as a starting material for producing sulfuric acid.

12 Claims, 7 Drawing Figures

FIG. 6

REVERBERATORY SMELTING OF NON-FERROUS METAL SULFIDE ORES

BACKGROUND OF THE INVENTION

This invention relates to improvements in the smelting of non-ferrous metals, particularly copper and nickel. More specifically, the invention relates to increasing the processing capacity of reverberatory furnaces, elevating the efficiency of energy utilization, and facilitation of exhaust gas treatment for the purposes of preventing pollution.

As one example of smelting of non-ferrous metals, copper smelting may be considered. A copper smelting process widely practiced at present may be broadly divided into two stages, i.e., a smelting stage wherein a sulfide ore (which is hereinafter used collectively as a generic term for starting materials charged into reverberatory furnace as copper smelting starting materials such as ores and concentrates) is heated to be melted and oxidized thereby to give an anode of a copper content of at least 99 percent, and an electrolytic refining stage wherein this anode is electrolyzed to produce electrolytic copper. The smelting stage further comprises a smelting step wherein the ore is melted to concentrate the copper value into matte, a copper producing step wherein the matte is oxidized and thereby converted into blister copper, and a refining step wherein the blister copper is refined and cast into an anode, these steps being carried out successively and consecutively in the stated order.

This invention provides a novel method of operating a reverberatory furnace used in the ore smelting step of the above stated steps.

In general, reverberatory furnaces have been used from early times for smelting copper ores, and, even today, a large number of these furnaces are in actual operation at various places in the world because of their advantageous features such as their suitability for processing large quantities of ores, the great ranges of kinds and grades of ores which they can process, and the relative simplicity of the manipulative procedure for their operation. However, this method of using a reverberatory furnace is accompanied by certain problems such as the following.

(1) Because of the mechanism of the reverberatory furnace operation wherein combustion burners are operated in an open space and radiation heat and convection heat are chiefly utilized, the fuel consumption rate is high, whereby this type of furnace is not necessarily advantageous in this age of high energy cost.

(2) Because of the flat construction of the furnace, the processing capacity per unit area of the furnace bath, that is, the furnace bath efficiency, is low, and the overall efficiency is poor.

(3) Since the fuel is consumed in a large quantity, the gases generated from the ore are diluted by the combustion gases, and the $SO_2$ concentration of the exhaust gases from the furnace is low. Moreover, since the gas quantity is large, the cost of gas treatment for prevention of pollution increases.

(4) The grade of the copper within the matte is dependent chiefly on the composition of the starting material ore, and little room is left for control thereof. For example, when ordinary ore of a copper content of the order of 28 percent is processed by the green charge method (i.e., a method wherein a starting material concentrate is charged into the furnace without being roasted or calcined and with a moisture content of the order of 7 to 8 percent), the copper content within the matte (i.e., matte grade) is of a low value of the order of 36 to 38 percent, which accordingly gives rise to an increase in the load for matte treatment in the converter.

When the calcine charge method (i.e., a method wherein the starting material ore is calcined beforehand, a portion of the sulfur being removed, and is then charged into the furnace) is used, the matte grade becomes a value of the order of 45 to 55 percent. However, if the matte grade is raised above this range, the copper content within the slag will abruptly increase to result in copper loss. Another difficulty is that the calcine charge method requires large-scale equipment for pretreatment. Furthermore, in the reverberatory furnace, the only operation carried out is melting of the ore to separate it into matte and slag, and oxidation of the matte is not actively carried out. For this reason, heat of oxidation cannot be utilized for melting the ore, and this is one cause of the high fuel consumption rate of a reverberatory furnace.

For the purpose of overcoming these difficulties, various attempts to improve the construction and control procedure of reverberatory furnaces have been made. For example, in the process disclosed in U.S. Pat. No. 3,436,068 (Japanese Pat. No. 18042/1969), a water-cooled lance is used to blow air into the melt within a green charge type reverberatory furnace thereby to cause the melt to be splashed onto the ore bank and promote the rate of melting of the ore. In the process disclosed in U.S. Pat. No. 3,664,828, the ore is melted in a furnace of the shape of a reverberatory furnace, a lance being inserted therethrough at the same time to blow air into the melt and thereby to convert the matte into blister copper, and the above mentioned two reactions of the smelting step and the copper producing step are caused to progress in the same furnace.

However, in the process disclosed in U.S. Pat. No. 3,436,068, since the slag layer in a reverberatory furnace is ordinarily of a thickness of 40 cm. or more, the air blown in ordinarily does not reach the matte layer, whereby effective oxidation thereof is not carried out. Even if air is blown to the matte layer, a great amount of splashing will occur and mechanically carry ore particles and matte particles into the slag layer to become suspended therein. These particles are thus not separated, whereby the copper loss tends to increase. In addition, a water-cooled lance is easily clogged, and, if the cooling water should leak and contact the matte within the furnace, there would be the danger of an explosion. Thus, this process entails complications in handling, which cannot be avoided even if a cooling medium other than water is used.

The process disclosed in U.S. Pat. No. 3,664,828 is characterized in that the interior of the furnace is provided with zones for carrying out three different functions, namely, a melting zone, a converting zone, and a settling zone. Because of the mutual interaction of these zones, not only is the manipulative procedure for controlling the process extremely difficult, but, in actual operation, demarcations of these zones with different functions become indistinct, whereby the distribution of the belt becomes obscure and the control of the respective zones becomes difficult. Furthermore, in order to carry out slag-matte separation by agitation of the melt by blowing air thereinto through the lance and settling, a larger settling time becomes necessary, and for this reason the settling zone must be widened, or a thick slag layer must be formed. Widening of the settling zone means an increase in the bath area of the furnace, which will give rise to an increase in heat loss. Forming a thick slag layer necessitates an elevation of the pressure of the blown-in-air, which, as a natural result, will lead to a vigorous flow movement of the melt, whereby the resulting rapid wear of the refractory materials of the furnace wall will constitute an economically great load. Furthermore, vigorous agitation naturally will increase the quantities of the matte and starting material ore suspended in the slag, and the copper content in the slag will become high even after passage through the separation region, which will cause an increase in copper loss.

In this connection, there has also been proposed a so-called continuous copper production process as disclosed in U.S. Pat. No. 3,890,139 (Japanese Pat. No. 43015/1976) which was assigned to the assignee of this application. This process comprises: a first process step in which a metal sulfide ore as a starting material is blended with a flux and/or fuel and continuously blown into the melt by pressurized air to be melted; a second process step in which all the product of the first process is charged into a separation furnace and thereby separated into matte and slag, which are taken out; and a third process step in which the matte and an appropriate proportion of flux are continuously charged into a copper producing furnace, and white matte or blister copper and converting furnace slag are produced. These process steps are so arranged that they can be controlled independently of one another, and means are provided to convey the melts continuously between the furnaces in which these process steps are carried out. In the melting of the starting material ore in the above stated first process step, the ore is melted by blowing it into the melt in a smelting furnace with the object of increasing the melting efficiency. It is also suggested in the patent that a reverberatory furnace can be used for this smelting furnace.

However, the above described first process step is still accompanied by a number of problems, the most difficult of which are as follows.

(a). Since, in the above described process, an improvement in the melting efficiency is sought by blowing the starting materials continuously into the hot melt, the melt is vigorously agitated, whereby the corrosion of the furnace wall bricks is severe. For this reason, measures such as installing jackets in the bricks for cooling are being resorted to, but the heat efficiency decreases, and even with such measures, it is necessary to stop the operation periodically and to make repairs. Such damage is unavoidable as long as the melt contacts the furnace surface.

(b). In the above described process, all of the starting material must be subjected to a pretreatment such as drying or calcining thereby to remove moisture and a portion of the sulfur content and to impart fluidity to the material before it is fed. For this reason, a pretreatment step becomes necessary, and large-scale equipment is required. However, a smelting furnace cannot be easily made large since, as mentioned above, it must be periodically repaired, and for ordinary operation, it becomes necessary to have a plurality of lines of equipment, whereby the installation cost is further increased.

(c). In a method such as that of the above mentioned process, wherein the total quantity of the matte and the slag is fed into the second furnace, the load on the second furnace increases. For this reason, it cannot be said that the method is advantageous in all cases from the viewpoint of economy of equipment and heat. This point is particularly important in providing an improved method of smelting with a reverberatory furnace which is operated, not by a consistent, continuous process up to the copper producing process step as in the above mentioned process, but in combination with a final copper producing process such as that in a converter.

SUMMARY OF THE INVENTION

It is a principal object of this invention to overcome the difficulties encountered in the prior art as described above, thereby to provide a novel and improved method of operating a reverberatory furnace for smelting of nonferrous metal sulfide ores.

Another object of the invention is to improve the efficiency of reverberatory furnaces which have already been installed and to produce matte having increased copper contents.

Still another object of the invention is to increase the processing capacities of already existing reverberatory furnaces.

A further object of the invention is to provide a method of operating a reverberatory furnace which makes possible efficient treatment of exhaust gas.

An additional object of the invention is to provide a method of operating a reverberatory furnace which affords prolonging of the serviceable life of the furnace wall.

As a result of our research, we have discovered that these objects can be achieved by a procedure which comprises: forming banks or piles of green ore along the side walls of a reverberatory furnace of green-charge type, thereby to protect the side walls; forming matte and slag by melting these ore banks; causing the slag to flow out of the furnace together with a portion of the matte to be introduced into a second separation furnace, where complete separation is accomplished to process each of the matte and slag; and reducing as much as possible the thickness of the slag layer in the reverberatory furnace and blowing an oxygen-containing gas through the thin slag layer into the matte while the air pressure is reduced, thereby to carry out the step with minimum energy consumption for blowing and, at the same time, to reduce to a minimum the wear of the refractory materials due to agitation and splashing of the melt. During this operation, the remainder of the matte is drawn directly out also from the lower layer of the reverberatory furnace, thereby to lighten the load on the second separation furnace.

According to this invention in a principal aspect thereof, briefly summarized, there is provided a method for smelting a non-ferrous metal sulfide ore to produce matte enriched with the metal by means of a series of furnaces comprising a reverberatory furnace having a main structure having refractory sidewalls and transverse refractory end walls, a roof covering the main structure, burners at one end wall, feeding hoppers disposed in rows parallel to and near the sidewalls, at least one lance for introducing an oxygen-containing gas, a matte tapping port, a slag-and-matte overflow weir and means for conducting exhaust gas out of the furnace, and a separation furnace combined with the reverberatory furnace through the slag-and-matte overflow weir and having inlet means, heating means, and a matte tapping port and a slag tapping port, which method comprises the steps:

(a) in the reverberatory furnace, of (i) charging the metal sulfide ore through the feeding hoppers into the furnace thereby to form ore piles as banks along the sidewalls, (ii) burning a fuel by means of the burners thereby to melt the ore banks and to form a melt bath comprising a matte layer and a slag layer overlying the matte layer, (iii) tapping a mixture of the slag and a portion of the matte out of the furnace through the slag-and-matte overflow weir thereby to maintain the slag layer within the furnace at a small thickness, (iv) introducing the oxygen-containing gas through the lance into the melt bath thereby to oxidize sulfur in the matte and to increase the content of the metal in the matte, (v) tapping the remainder of the matte out of the furnace through the matte tapping port, and (vi) discharging the exhaust gas formed by the combustion of the fuel and the oxidation of the sulfur through said means for conducting exhaust gas out of the furnace; and (b) in the separation furnace, of (i) introducing the mixture of slag and matte which has overflowed from the reverberatory furnace through the inlet means into the separation furnace, (ii) separating, by settling, the mixture as it is heated thereby to form matte and slag layers, (iii) tapping the matte out of the furnace through the matte tapping port, and (iv) tapping the slag out of the furnace through the slag tapping port.

The nature, utility, and further features of this invention will be apparent from the following detailed description beginning with a consideration of general aspects of the invention and concluding with specific examples illustrating preferred embodiments of the invention.

DETAILED DESCRIPTION

As conducive to a full understanding of the nature and utility of this invention, an example of a known method will first be described briefly for the purpose of comparison.

Figure 1:
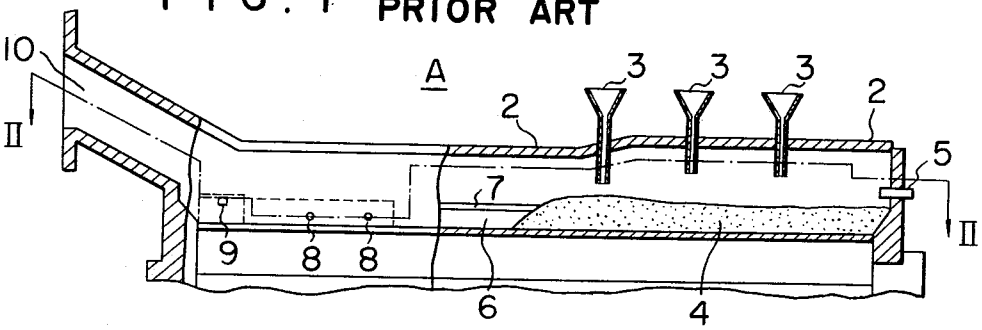
FIG. 1 PRIOR ART
FIG. 1 is a side elevation, with parts in longitudinal section and parts cut away, of a reverberatory furnace operated in accordance with a known method.
Figure 2:
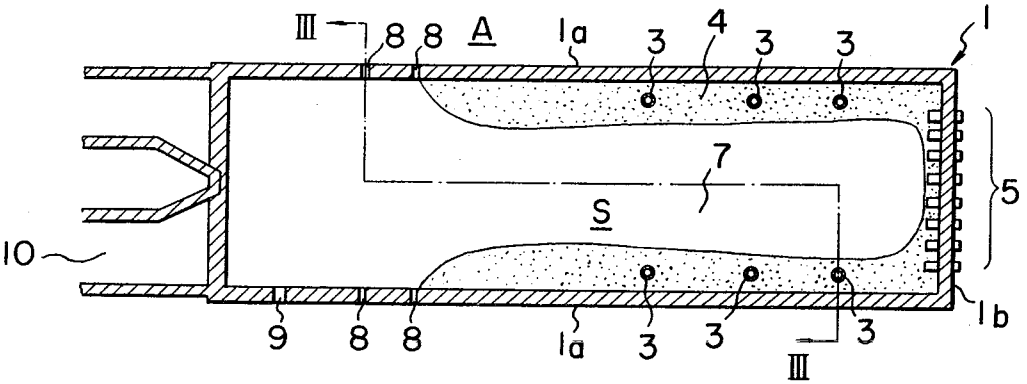
FIG. 2 PRIOR ART
FIG. 2 is section taken along the surface indicated by line II—II in FIG. 1 as viewed in the arrow direction.
Figure 3:
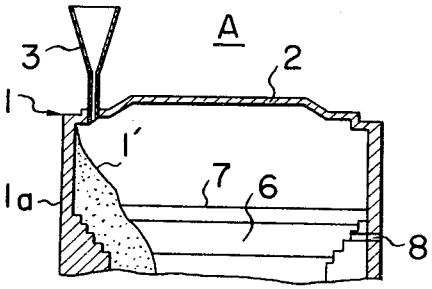
FIG. 3 PRIOR ART
FIG. 3 is a section taken along the surface indicated by line III—III in FIG. 2 as viewed in the arrow direction.

According to the known method, as indicated in FIGS. 1, 2, and 3, a reverberatory furnace A having a main wall and base structure 1 made of fire brick and having, as a whole, a substantially rectangular shape and a roof 2 made of fire brick and covering the main structure 1 is used. The roof 2 is provided with a plurality of spaced-apart hoppers 3 in two rows extending in the furnace longitudinal direction and respectively disposed near the two sidewalls 1a, 1a of the main structure 1. Green sulfide ore is fed continuously or intermittently through these hoppers 3 to form ore piles or banks 4, 4 within the furnace. Through holes in one end wall **1*b* of the main structure 1, a plurality of burners 5** are installed in a horizontal transverse row, each burner being slightly declined in the forward direction by an angle of approximately 2 degrees, for example.

A fuel such as fuel oil is burned by the burners 5 to melt the ore banks 4, 4 gradually from their outer surfaces and thereby to form a melt on the furnace bottom. This melt is progressively separated as a result of difference in specific gravity into matte 6 and slag 7, which are then tapped out of the furnace respectively through matte tap holes 8 and slag tap holes 9. In order to thoroughly separate the melt into the matte 6 and the slag 7 thereby to reduce as much as possible the copper content in the slag, a considerably large settling zone S is considered to be required. Moreover, by causing the thickness of the slag layer 7 to be of a considerably large value of the order of, for example, 40 cm. and draining off the overflow from the upper surface, the retention time of the slag in the furnace is prolonged, and the physical suspension of the matte and the starting material ore in the slag is prevented thereby to reduce the copper loss.

The resulting exhaust gas containing $SO_2$ produced by the combustion of the fuel and oxidation of sulfur in the starting material ore is discharged out of the furnace through a flue 10 at the end of the furnace remote from the burners 5. The $SO_2$ content of the exhaust gas thus discharged is of the order of 2 to 3 percent. In the case where a copper concentrate of an ordinary chalcopyrite origin is being processed, the copper content in the matte produced is of the order of 36 to 38 percent.

Figure 4:
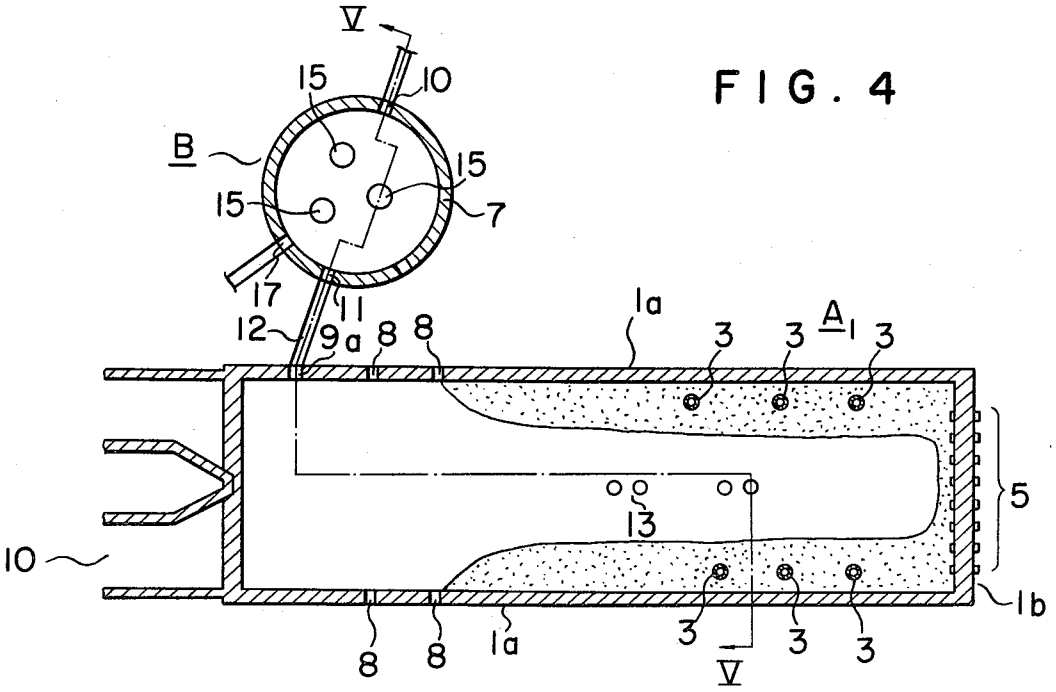
FIG. 4 is a plan view, in horizontal section, corresponding to FIG. 2 and showing an example of an apparatus used in the practice of the method of the invention.
Figure 5:
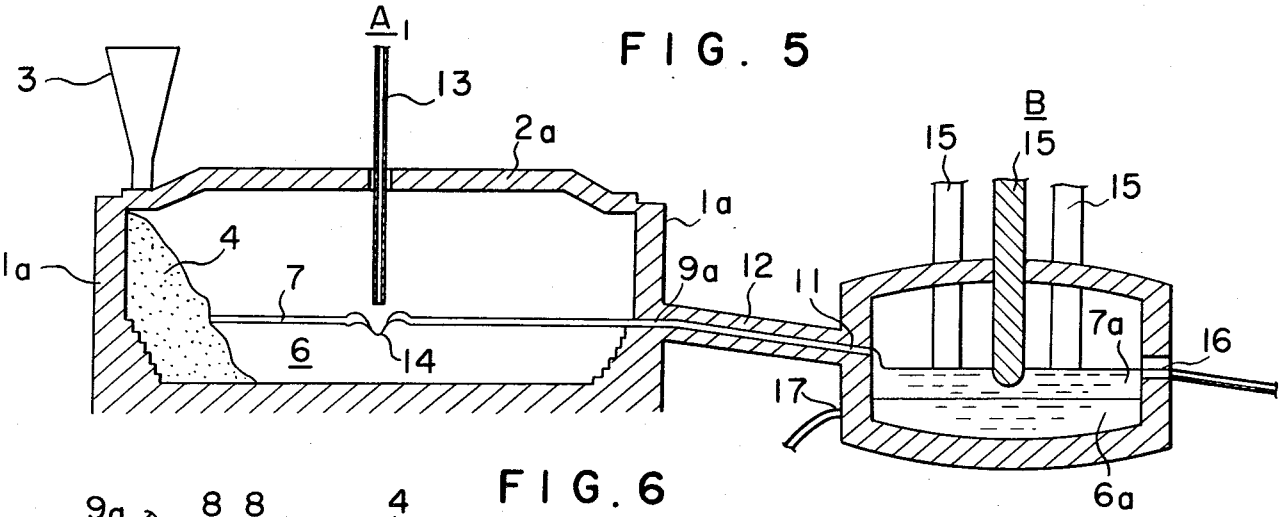
FIG. 5 is a section taken along the surface indicated by line V—V in FIG. 4 as viewed in the arrow direction.

One example of an apparatus for practicing the method of this invention is illustrated in FIGS. 4 and 5, whose views correspond respectively to those of FIGS. 2 and 3. The reverberatory furnace $A_1$ of this apparatus is generally similar to the above described furnace of the known method, but instead of the slag tap hole 9, a slag and matte overflow weir **9*a* is provided. In addition, a separation furnace B for carrying out final separation of the slag-and-matte is provided, and an inlet means 11 provided in a sidewall part thereof is connected by a launder 12 to the slag-and-matte overflow weir 9*a* of the reverberatory furnace $A_1$. Furthermore, a lance 13 for blowing an oxygen-containing gas into the melt in the reverberatory furnace $A_1$ is inserted into this furnace $A_1$ through its roof 2*a***.

This invention will now be described with respect to an example of typical mode of practice thereof in specific terms. It should be understood, however, that the specific details set forth below are presented as illustrative only and are not intended to limit the scope of the invention.

A green-charge reverberatory furnace $A_1$ of standard type of, for example, a length of 30 meters (m.), a width of 10 m., and a height of 3.7 m. is provided with several hoppers (only 6 hoppers shown in FIG. 4) in longitudinal rows respectively near the two sidewalls, the hoppers in each row being provided at spacing intervals of approximately 1 m. Through these hoppers, a copper concentrate (of an average particle size of approximately 200 mesh) having a composition comprising 28.6 percent of Cu, 27.0 percent of Fe, 29.0 percent of S, and 7.5 percent of $SiO_2$, and a water content of approximately 7 percent, all percentages being by weight, is charged into the furnace at a rate of approximately 1,070 metric tons/day thereby to form the ore banks 4, 4 and thereby to protect the furnace sidewalls.

On one hand, eight burners 5 each having a C fuel oil combustion capacity of 800 liters/hour are operated to melt the ore banks 4, 4 from their outer surfaces by the radiation heat due to combustion. The melt thus produced is caused to gradually separate to form a matte layer 6 and a slag layer 7. The fuel combustion is carried out at a substantially constant rate to maintain a specific production rate. After the charged material of one batch has been melted, the succeeding batch quantity is charged. The fuel consumption and the rate of supply of the starting materials to be melted are so adjusted that the temperatures of the matte, the slag, and the exhaust gas are maintained respectively at 1,180°to 1,210° C., 1,200° to 1,250° C., and 1,200° to 1,250° C.

On the other hand, as shown in FIGS. 4 and 5 a lance device comprising four 3-inch pipes 13 extending vertically downward into the furnace through the roof 2*a* thereof is provided. These lance pipes 13 are disposed in a single row parallel to and equidistant from the two sidewalls 1*a* of the furnace at respective distances of 11 m., 12 m., 17 m., and 18 m. from the burner wall 1*b*. Through these lance pipes 13, pressurized oxygen-enriched air containing 35 percent $O_2$ is blown against the melt at a flow velocity of 150 m./sec. The pressurized air thus blown forms craters 14 in the melt, and the matte layer 6 thus exposed is oxidized. By this technique using lances, it is possible to increase the rate of smelting ore by 35 percent from 800 metric tons/day to 1,070 metric tons/day and to increase the matte grade from 37 percent to 45 percent without increasing the fuel consumption.

Approximately two thirds, or 500 metric tons/day, of the matte 6 formed in this manner is taken out of the furnace through the matte tap hole 8. The remainder of the matte and the total quantity of the slag, as they are, i.e. without being fully separated, are caused to be transferred by overflowing through the slag-matte tap hole 9*a* and the launder 12 to the separation furnace B. By this procedure, the thickness of the slag layer 7 can be reduced to approximately 50 to 100 mm. from that in the known method of approximately 400 mm. or more. At this time, the thickness of the matte layer is approximately 1 to 1.2 mm. As the slag layer thickness is thus reduced, it is possible to reduce the pressure of blowing through the lance pipes to a value at the lance inlet of 1 to 3 kg/cm.$^2$ and still carry out ample oxidation of the matte.

In contrast, in a known method, a pressure of more than 5 kg./cm.$^2$ is necessary with 3-inch lance pipes, for example, to deliver by means of these pipes the oxygen-containing gas through the thick slag layer as mentioned above into the underlying matte layer. This not only requires a great energy consumption but also gives rise to damage such as corrosion of the firebricks constituting the furnace roof and walls and the lance pipes themselves due to splashing of the melt and adhesion thereof caused by the blown gas. Furthermore, the resulting violent movement of the melt causes a physical erosion of the refractory materials contacting the melt within the furnace and of the banks of the starting material ore piled up in the furnace and gives rise to disorderly conditions of the furnace, a pronounced impairment of the serviceable life of the furnace, and other undesirable results. Consequently, actual operation by the use of lance pipes as in this invention is difficult.

In accordance with the method of this invention, in another aspect thereof, exhaust gas of an $SO_2$ concentration of 5 percent is exhausted at a flow rate of 1,220 Nm.$^3$/min. through the exhaust flue and is used, as it is, as a starting material for a sulfuric acid production process.

The matte-slag mixture melt tapped from the reverberatory furnace is transferred through the launder 12 and ordinary inlet means into an electric furnace B functioning as the separation furnace. This electric furnace B has a circular furnace floor surface of a diameter of 8 m. and, in the central part thereof, three spaced-apart carbon electrodes 15, which extend vertically downward through the furnace roof and at their lower ends are immersed in the slag layer 7*a* at the upper part of the melt. Heat is generated because of the electrical resistance of the slag between these electrodes when voltage is applied thereto.

This electric furnace B has a capacity of 2,500 KVA and a normal-use output of 1,500 KW. The power input is so adjusted as to maintain the slag temperature at 1,200° to 1,280° C. The slag is retained in this electric furnace for approximately 3 to 5 hours thereby to cause the copper content to be as low as possible, and thereafter slag of a copper content of 0.5 percent is taken out of the furnace through a slag tap hole 16 at a rate of 700 metric tons/day. Matte of a copper content of 45 percent is drained out through a matte tap hole 17 at a rate of 250 metric tons/day. This matte is processed together with the 500 metric tons/day of the matte taken out directly from the reverberatory furnace in an ordinary PS converter.

The method of this invention which has been described above with respect to one fundamental example thereof will now be further described in a somewhat general mode of practice.

In general, it is necessary to determine the installation positions of the lance pipes 13 with due consideration of their distances from the furnace wall. More specifically, a position which can be directly reached by the flame of a burner is at a high temperature. If a lance pipe were placed in such a position, it would be severely damaged. Furthermore, if a lance pipe is too near a furnace wall, the bank of heaped charge will collapse, and the wall protecting materials will become thin, whereby the furnace wall will be damaged. If a lance pipe is positioned near the exhaust gas outlet, droplets of the melt will splash onto and accumulate on the sides of this outlet, whereby there is a possibility of the gas flue becoming clogged. For these reasons, in the case of a reverberatory furnace of standard size of, for example, a length of 30 m. and a width of 10 m., the limits of the desirable positions of a lance pipe are at least 5 m. from the burner wall, at least 5 m. from the wall of the exhaust gas flue, and at least 2 m. from a sidewall. The lower tip of a lance is ordinarily positioned at a height which is of the order of 300 to 400 mm. above the surface of the melt.

For the oxygen-containing gas blown through the lance, air, as it is, can be used alternatively as a gas other than oxygen-enriched air. However, for the purpose of increasing the reaction speed and reducing the exhaust gas quantity, thereby to use the exhaust gas, as it is, as a starting material gas for production of sulfuric acid, the oxygen enrichment of the blown air is highly effective. In this case also, the optimum concentration of the oxygen in the oxygen-enriched air is determined as a matter of course from a consideration of the cost of producing the oxygen and the equipment, but when the oxygen content is enriched to the order of up to 30 to 45 percent of $O_2$, the resulting enriched air can be handled in the plant in substantially the same manner as ordinary air. Thus such a concentration is convenient.

For the lances, in general, straight pipes of a nominal diameter of 2 to 3 inches are convenient for handling. In the case where the oxygen-containing gas is supplied at a flow velocity of the order of 100 to 200 m./sec., preferably 150 m,/sec. as described above, the gas cools and protects, from the pipe interior, each lance inserted into the furnace. For this reason, it is possible to use solid-drawn steel pipes for the lances, but in order to simplify work procedures such as adjustments necessitated by wear, the use of stainless steel SUS 304 of the Japanese Industrial Standards (JIS) (similar to AISI 304 of the American Iron and Steel Institute) or some other heat-resistant and erosion-resistant material is more effective and preferable. The two ends of each lance pipe should preferably be provided with beveling so that, when the pipe eventually becomes short because of wear, a new pipe can be conveniently joined by welding to the upper end of the short pipe.

In ordinary operation, together with the starting material ore, a flux such as silica and limestone is supplied in a quantity of the order of 4 percent of that of the ore. In the method of this invention, however, the oxygen-containing gas blow through the lances causes FeS in the matte to be oxidized in the reverberatory furnace to form FeO, and as the oxidation progresses further, there is the undesirable possibility of a portion of this FeO becoming magnetite ($Fe_3O_4$). Because of its high melting point and also high viscosity, magnetite impairs the fluidity of the slag and increases the copper loss. In addition, magnetite accumulates on the furnace bottom and causes a reduction in the effective volume in the furnace.

One measure for preventing the occurrence of this difficulty is to blow into the melt, together with the oxygen-containing gas, a flux such as silica and limestone in a quantity corresponding to the quantity of the FeO produced by the blowing in of the oxygen-containing gas, that is, for example, in a quantity of approximately 5 to 10 percent of that of the ore. As a result of this measure, by supplying the flux in a concentrated manner in the region of formation of FeO by the blowing in of the gas, the FeO is rendered into a slag of e.g. ferrosilicate type and thereby can be immediately fixed.

Furthermore, the heat of oxidation generated as a result of the blowing in of the oxygen-containing gas serves to increase the ore processing capacity of the reverberatory furnace. More specifically, since the oxidation of FeS is carried out by the lancing, and the melt temperature rises, the melting speed of the charged ore is elevated by that much, and ore can be replenished correspondingly through the hoppers. However, it is also possible to blow into the melt through the lances the starting materials in a quantity corresponding to the increase in melting capacity or in a greater quantity. In this case, the melting of the ore is accomplished by the combination of radiation heat from the flames of the fuel and conductive heat directly transferred with the melt. For this reason, the melting efficiency improves, but it is essential in this instance also, in order to protect the furnace walls and floor from erosion, to charge through conventional ore hoppers at least 30 percent of the total quantity of the charged starting material thereby to form a bank of yet unmelted starting material in a manner to protect the furnace walls and floor.

Figure 6:
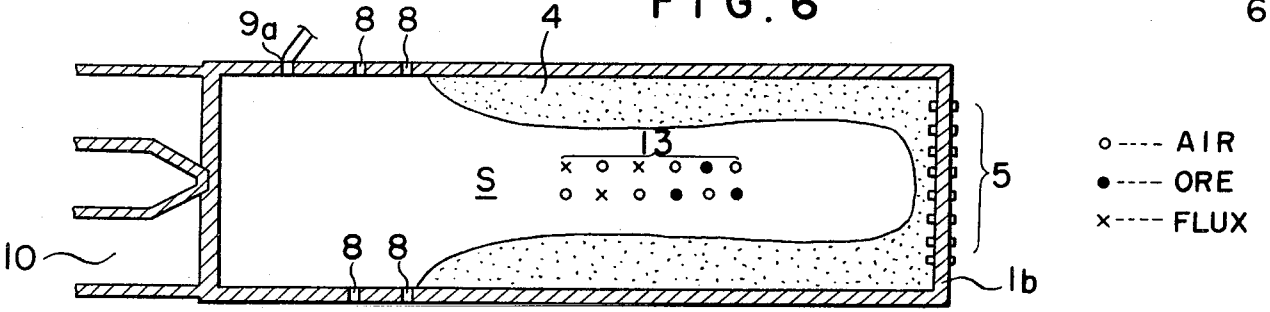
FIG. 6 is a plan view, in horizontal section, corresponding to FIG. 5 but showing a different lance arrangement.

In order to supply the ore or flux directly into the melt through the lances in this manner, the lances are arranged as shown in FIG. 6, for example. In the illustrated example, blank circles ○ designate air lances; dark circles ● designate ore lances; and crosses X designate flux lances. This supplying of the ore or flux can be carried out by a supply system such as that illustrated in FIG. 7. In this system, a hopper 18, into which dried ore or flux is fed, is installed at a level above the furnace. From the bottom of the hopper 18, an ore-supply pipe 19 connected hereto thereto extends downward to and through a lance head 20 and further downward through a part of the interior of a lance pipe 13*a* extending downward from the lance head 20 into the furnace. An air-supply pipe 21 is also connected at its downstream end to the lance head 20 to supply air through an annular space between the lance pipe 13*a* and the ore-supply pipe 19.

The dried ore or flux fed into and temporarily retained in the hopper 18 is controllably supplied through the ore-supply pipe 19 and is blown into the melt in the furnace together with the oxygen-containing gas supplied through the air-supply pipe 21 and into the above mentioned annular space in the lance pipe 13*a*. It is desirable that the ore or flux thus supplied be in the form of dried particles of an average particle size of 3 mm. or less.

While the number of air-supply lances 13 is appropriately selected on the basis of the air flow rate necessitated by factors such as the furnace size and the rate at which the starting material is to be melted, it is preferable, in general, that this number be so determined that the copper content in the matte will be 40 to 60 percent. The reason for this is that, in general, when the blown-in air flow rate is increased to increase the matte grade, the load on the converter for the subsequent processing is reduced, and the processing capacity with the same equipment is increased. On the other hand, since the copper content in the slag which has contacted this matte also increases, there is naturally a limit to the rise of the copper content in the matte in the case where the slag is not subjected to an after-treatment but is discarded.

Tapping out a portion of the separated matte from the matte tapping hole 8 is critical for reducing the operational cost since the load on the separation furnace B is reduced by that much. While the quantity of the matte thus tapped depends on the degree of matte-slag separation in the reverberatory furnace $A_1$, it is desirably, in general, in the range of $\frac{1}{2}$ to $\frac{3}{4}$ of the quantity of the matte formed.

For the separation furnace B, any type can be used insofar as it is provided with suitable heating means for maintaining or raising the temperature of the slag-matte mixture supplied thereinto and is capable of affording a retention time under settling conditions sufficient for thorough separation of the slag and matte. For example, a retention time of the slag of 2 hours or more is sufficient. An electric furnace is desirable for this purpose as mentioned hereinabove, but, alternatively, a reverberatory furnace can also be used.

In the above described example, the tapping of the matte from the matte tapping hole 8 of the reverberatory furnace $A_1$ and the matte tapping hole 17 of the electric furnace is carried out intermittently, similarly as in known methods. However, when syphon-type overflow weirs positioned at height levels somewhat lower than the slag-matte tapping hole 9*a* or the slag tapping hole 16 are used for these matte tapping holes, continuous tapping of the matte becomes possible. In this case, the height level differences relative to the tapping hole 9*a* or 16 determine the thicknesses of the slag layer in their respective furnaces.

Another important feature of the method of this invention is that an effective processing of the exhaust gas becomes possible simultaneously with the smelting of the ore.

As mentioned hereinbefore, a reverberatory furnace produces a large quantity of fuel combustion gas because of its construction and, moreover, has a low furnace floor efficiency, whereby the concentration of $SO_2$ in the exhaust gas is, in general, of the order of 2 percent, which is low for processing in a sulfuric acid plant. For this reason, the exhaust gas of a reverberatory furnace has heretofore been considered to be of no use and has been discharged through tall stacks. Even at present, this appears to be the general practice in almost all countries.

However, from the viewpoint of prevention of pollution, there is a need to resort to some measure for treating the exhaust gas. For this purpose, the cost of gas treatment becomes extremely high because of the tremendous quantity of the gas and the relatively low concentration of the $SO_2$. This difficulty of treating the exhaust gas has been to date one of the greatest bottlenecks in smelting by means of a reverberatory furnace.

In accordance with the method of this invention, lancing is carried out with respect to the melt in a reverberatory furnace thereby to oxidize a part of the matte. For this reason, the $SO_2$ concentration in the exhaust gas becomes higher. That is, an exhaust gas of concentration of the order of 4 to 9 percent is obtained, in general, and can be used directly as it is as a starting material in the production of sulfuric acid. At present, in view of the added value of the product, production of sulfuric acid is the most economical as a treatment of smelting exhaust gas. Accordingly, it will be evident that the method of this invention is highly suitable also for exhaust gas treatment.

While the method of this invention has been described above with respect to smelting of copper sulfide ore, it will be apparent to those skilled in the art that the method is effective also for the smelting of other ores of sulfides of other non-ferrous metals, such as nickel, having properties similar to those of copper.

In order to indicate more fully the effectiveness and utility of the method of this invention, the following examples are set forth, it being understood that these examples are presented as illustrative only and are not intended to limit the scope of this invention.

EXAMPLE 1.

Figure 7:
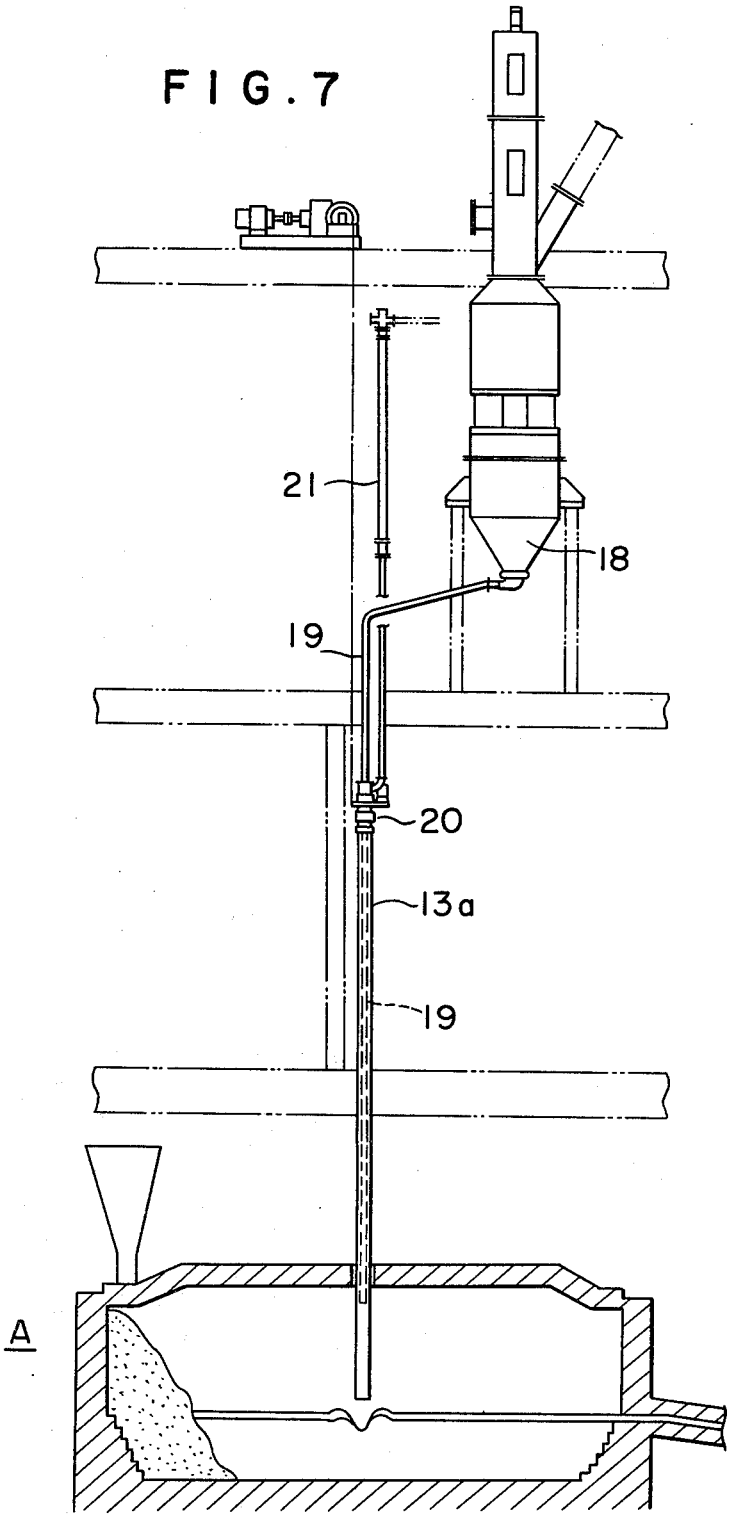
FIG. 7 is an elevation, with parts cut away and parts in vertical section, showing the arrangement of a lance device for blowing in ore or flux together with an oxygen-containing gas.

Reverberatory smelting of a non-ferrous metal sulfide ore was carried out according to the fundamental mode of practice of the method of this invention described hereinbefore with reference to FIGS. 4, 5 and 7. The working conditions and results are set forth in the following table.

EXAMPLE 2.

In the furnace used in Example 1, the same starting material used in Example 1 was smelted. In order to elevate the matte grade further to 60 percent from that in Example 1, 11 lances were used, and oxygen-enriched air of $O_2$ content of 35 percent was blown into the melt. Since the heat of oxidation is large in this case, this heat was utilized to increase the rate of smelting. For this purpose, of the above mentioned 11 lances, 3 each were used to blow 360 metric tons/day of ore concentrate and 210 metric tons/day of silicious flux, respectively, together with the oxygen-containing gas into the melt.

The lance arrangement was as indicated in FIG. 6, in which 6 pairs of lances were disposed to straddle the longitudinal centerline of the furnace, the lances of each pair being spaced apart by 1 m. The pairs of lances were spaced at 2-m. intervals, the pair nearest the burner end wall being at a distance of 11 m. therefrom. In FIG. 6, the symbol ○ designates a lance supplying only oxygen-enriched air, while symbols ● and × respectively designate lances supplying dried ore concentrate and flux together with oxygen-enriched air. One of the lances designated by ○ was a spare lance.

As a result of the above described operation, the rate of smelting of the ore became 1,600 metric tons/day, and a concentration of $SO_2$ in the exhaust gas of 8.3 percent was obtained. It was found that this exhaust gas could be used directly as a starting material in the production of sulfuric acid.

The results of Examples 1 and 2, as well as those obtained according to a known method, for the purpose of comparison, are set forth together in the following table.

| | | Example 1 | Example 2 | Known method |
|---|---|---|---|---|
| Processed ore T/D | | 1,070 | 1,600 | 800 |
| Silicious flux " | | 110 | 270 | 30 |
| Matte grade Cu % | | 45 | 60 | 37 |
| Matte production T/D | | 750 | 840 | 710 |
| Fuel oil l/T ore | | 127 | 102 | 160 |
| Number of lances | | 4 | 11 | 0 |
| Lance blowing pressure kg/cm$^3$ | | 2.5 | 2.5 | — |
| Lance air $O_2$ content % | | 35 | 35 | — |
| Exhaust gas flow rate Nm$^3$/min | | 1,220 | 1,690 | 960 |
| Exhaust gas $O_2$ content % | | 1.0 | 1.0 | 1.0 |
| Exhaust gas $SO_2$ content % | | 5.0 | 8.3 | 2.7 |
| Exhaust gas $CO_2$ content % | | 11.6 | 9.7 | 12.9 |
| Matte tapped T/D | Reverberatory furnace | 500 | 560 | 710 |
| | Electric furnace | 250 | 280 | — |
| Slag tapped T/D | | 700 | 1,040 | 525 |
| Slag Cu grade Cu % | | 0.5 | 0.49 | 0.5 |

Abbreviations-
T: metric ton
D: day
l: liter
m: meter

As indicated in the table, by the practice of this invention, the matte grade was greatly increased. For this reason, the processing time for the purpose of matte processing in the converter was reduced, contrary to expectation, in spite of the increase in the quantity of the starting material ore processed, thus resulting in an extremely great improvement in operational efficiency.

Furthermore, since the heat of oxidation of the matte was utilized for ore melting, the fuel oil consumption by the reverberatory furnace was remarkably reduced.

Further, since the concentration of $SO_2$ in the exhaust gas of the reverberatory furnace was from 5 to 9 percent, the entire quantity could be used as a starting material for production of sulfuric acid. The sulfur, which heretofore had been unavoidably fixed as gypsum, could be utilized in its entirety as a valuable starting material for sulfuric acid production. Accordingly, the method of this invention was found to be highly advantageous for preventing pollution.

What we claim is:

1. A method for smelting a nonferrous metal sulfide ore, a substantial portion of which is in a green state, to produce matte enriched with the metal by means of a series of furnaces comprising (A) a reverberatory furnace having a main structure having refractory sidewalls and transverse refractory end walls, a roof covering the main structure, burners at one end wall, feeding hoppers disposed in rows parallel to and near the sidewalls, at least one lance for introducing an oxygen-containing gas, a matte tapping port, a slag-and-matte overflow weir and means for conducting exhaust gas out of the furnace, and (B) a separation furnace combined with the reverberatory furnace through the slag-and-matte overflow weir and having inlet means, heating means, a matte tapping port and a slag tapping port, which method comprises the steps:

(a) in the reverberatory furnace, of (i) charging the portion of the metal sulfide ore which is in the green state through the feeding hoppers into the furnace thereby to form ore piles as banks along the sidewalls, (ii) burning a fuel by means of the burners thereby to melt the ore piles and to form a melt bath comprising a matte layer and a slag layer overlying the matte layer, (iii) tapping a mixture of the slag and a portion of the matte out of the furnace through the slag-and-matte overflow weir thereby to maintain the slag layer within the furnace at a small thickness, (iv) introducing the oxygen-containing gas through the lance into the melt bath thereby to oxidize the matte and to increase the content of the metal in the matte, (v) tapping the remainder of the matte out of the furnace through the matte tapping port, and (vi) discharging the exhaust gas formed by the combustion of the fuel and the oxidation of the sulfur through said means for conducting exhaust gas out of the furnace; and (b) in the separation furnace, of (i) introducing the mixture of slag and matte which has overflowed from the reverberatory furnace through the inlet means into the separation furnace, (ii) separating, by settling, the mixture as it is heated thereby to form matte and slag layers, (iii) tapping the matte out of the furnace through the matte tapping port, and (iv) tapping the slag out of the furnace through the slag tapping port.

2. A method as set forth in claim 1 in which the lance is disposed substantially vertically above the melt bath at a position separated at least 5 m. from the end wall with the burners, at least 5 m. from the opposite end wall, and at least 2 m. from each of the sidewalls.

3. A method as set forth in claim 1 in which the oxygen-containing gas is a gas selected from the group consisting of air and oxygen-enriched air having an oxygen content of up to 45 percent by volume.

4. A method as set forth in claim 1 in which a flux is blown together with the oxygen-containing gas into the melt through the same lance for blowing in the oxygen-containing gas or through another lance.

5. A method as set forth in claim 1 in which dried ore is blown together with the oxygen-containing gas into the melt through the same lance for blowing in the oxygen-containing gas or through another lance.

6. A method as set forth in claim 5 in which the quantity of the ore blown in through the lance is less than 70 percent by weight of the total quantity of the ore to be processed in the reverberatory furnace.

7. A method as claimed in claim 1 in which 50 to 75 percent by weight of the total quantity of the matte formed in the reverberatory furnace is tapped out of the reverberatory furnace through the matte tapping port.

8. A method as set forth in claim 1 in which the thickness of the slag layer in the reverberatory furnace is maintained at 50 to 100 mm.

9. A method as set forth in claim 1 in which an electric furnace is used for the separation furnace.

10. A method as set forth in claim 1 in which the exhaust gas generated in the reverberatory furnace is used, as it is, as a starting material for producing sulfuric acid.

11. A method as set forth in claim 1 in which the metal sulfide ore in the green state contains approximately 7 to 8 percent by weight of water.

12. A method as set forth in claim 1 in which, after the ore piles have been melted to form the melt bath in the reverberatory furnace, additional metal sulfide ore which is in the green state is charged through the feeding hoppers into the reverberatory furnace to form additional ore piles as banks along the sidewalls of the reverberatory furnace.

* * * * *